United States Patent [19]

Adam

[11] Patent Number: 4,720,613

[45] Date of Patent: Jan. 19, 1988

[54] CONTACT ARRANGEMENT FOR LOW-VOLTAGE CIRCUIT BREAKERS WITH MAIN CONTACTS AND BURN-OFF CONTACTS

[75] Inventor: Bernd Adam, Berlin, Fed. Rep. of Germany

[73] Assignee: Siemens Aktiengesellschaft, Munich, Fed. Rep. of Germany

[21] Appl. No.: 922,729

[22] Filed: Oct. 24, 1986

[30] Foreign Application Priority Data

Nov. 6, 1985 [DE] Fed. Rep. of Germany ..... 3539673

[51] Int. Cl.[4] ..... H01H 33/12

[52] U.S. Cl. ..... 200/146 R

[58] Field of Search ..... 200/146 R, 144 R

[56] References Cited

U.S. PATENT DOCUMENTS 3,784,775 1/1974 Gryctko ..... 200/146 R

FOREIGN PATENT DOCUMENTS 1000486 6/1957 Fed. Rep. of Germany .
2218420 10/1972 Fed. Rep. of Germany .
1690137 11/1977 Fed. Rep. of Germany .
434415 10/1967 Switzerland .
531785 1/1973 Switzerland .

*Primary Examiner*—Robert S. Macon
*Attorney, Agent, or Firm*—Kenyon & Kenyon

[57] ABSTRACT

A contact arrangement for low-voltage circuit breakers comprises a fixed and movable main contacts and fixed and movable burn-off contacts. With the burn-off contacts, arcing horns as well as an arc quenching chamber are associated. Upon heavy stress of the contact arrangement, partial arcs occurring at the main contacts are taken over by arc pieces and conducted to the arcing horns. Also in case of a larger number of main contacts, a relatively narrow arc quenching chamber can be used.

3 Claims, 2 Drawing Figures

CONTACT ARRANGEMENT FOR LOW-VOLTAGE CIRCUIT BREAKERS WITH MAIN CONTACTS AND BURN-OFF CONTACTS

BACKGROUND OF THE INVENTION

The present invent1on relates to a contact arrangement for low-voltage circuit breakers having main contacts for carrying a continuous current and burn-off contacts for igniting a switching arc in the entrance area of an arc quenching chamber and having arcing horns for transferring the switching arc into the arc quenching chamber, and wherein at least two main contacts are arranged in a row next to each other and at a distance therefrom at least one burn-off contact is arranged.

A contact arrangement of this kind has become known, for instance, from DE-A No. 2,218,420. Such contact arrangements are customarily chosen for transmitting a large current for an extended period of time with the smallest possible temperature rise of the contact arrangement. In principle, this is achieved by the provision that the main contacts work without an arc and are therefore not subjected to burn-off which could affect the contact surfaces adversely.

If such a contact arrangement is opened for switching off, the currents which initially flowed through the main contact are commutated to the burn-off contact so that only the latter are acted upon by the switching arc.

However, it is known that under certain conditions, especially if the contact arrangement is overloaded by very large currents, partial arcs can occur at the main contact even if the latter are opened before the burn-off contacts. To control such phenomena without danger to the contact arrangement, it is known to design the quenching baffles of the associated are quenching chamber widened in such a manner that entrance edges of the baffles are arranged opposite not only the burn-off contacts but also the main contacts (DE-A No. 2,218,420). This design of the quenching baffles, however, necessitates that the arc quenching chamber has the same width as the contact arrangement. With a multiplicity of interruption processes, this large volume of the arc quenching chamber would not be necessary, however, since only an arc occurring at the burn-off contacts needs to be transferred into the quenching chamber.

SUMMARY OF THE INVENTION

Starting out from this situation, it is an object of the present invention to provide a contact arrangement which permits using a relatively narrow arc quenching chamber which is substantially matched to the burn-off contact, even if the formation of an arc at the main contacts can be expected.

The above and other objects of the present invention are achieved by a contact arrangement for a low-voltage circuit breaker having main contacts for conducting a continuous current and burn-off contacts for igniting a switching arc in the entrance area of an arc quenching chamber and further having arcing horns for transferring the switching arc into the arc quenching chamber wherein at least two main contacts are arranged in a row next to each other and at a spacing therefrom at least one burn-off contact is arranged, an arc guiding piece of ferromagnetic material being arranged in the space between the main contacts and the burn-off contact.

The effect of the arc guiding piece is based on the well-known phenomena that arcs are attracted by ferromagnetic parts and can be directed in this manner into a desired direction (see, for instance, DE-A No. 1,690,137). By the arc guiding pieces, partial arcs occurring at the main contacts in the case of an overload are attracted and appropriately guided. Due to known commutating processes they then arrive, for instance, at the burn-off contact or at the arcing horns and combine at these parts to form a uniform switching arc. Since thus, only the latter needs to be transferred into the arc quenching chamber, it is sufficient to match the dimensions of the arc quenching chamber to the burn-off contact. Due to its smaller volume, the arc quenching chamber can be produced less expensively than with the known embodiment with widened quenching baffles.

For transferring the partial arcs from the main contacts to the burn-off contact, it has been found advantageous to make the arc guiding pieces with an approximately triangular shape, where always one side of the triangular shape covers the main contacts and a further side covers the space between the upper edge of the main contacts and the upper edge of the associated burn-off contact. In this manner, effective guiding edges for the partial arcs are formed.

Two edges of the triangular shape can also be arranged so that they are at an acute angle which leads to the arcing horn of the associated burn-off contact. It can be achieved in this manner that the partial arcs join the main arc only at the arcing horn and additional stress of the burn-off contacts is eliminated.

The arc guiding pieces provided according to the invention can be punched and formed parts consisting of sheet steel or they may be ferromagnetic castings. It has been found that the mass of the arc guiding pieces, i.e., their thickness for a given area, has an influence on the desired action. Depending on the desired action, it may therefore be advantageous to use arc guiding pieces with greater or smaller thickness. If they are designed as castings it is found to be advantageous to provide a thick-walled part for guiding arcs and a thin-walled part for fastening.

In principle, the fixed part as well as the movable part of the contact arrangement can be provided with arc guiding pieces, or both parts of the contact arrangement can be equipped with arc guiding pieces. It has been found that favorable action can be achieved by equipping the fixed part accordingly.

BRIEF DESCRIPTION OF THE DRAWINGS

The invention will be explained in greater detail in the following detailed description with the aid of an embodiment shown in the drawings, in which.

DETAILED DESCRIPTION

Figure 1:
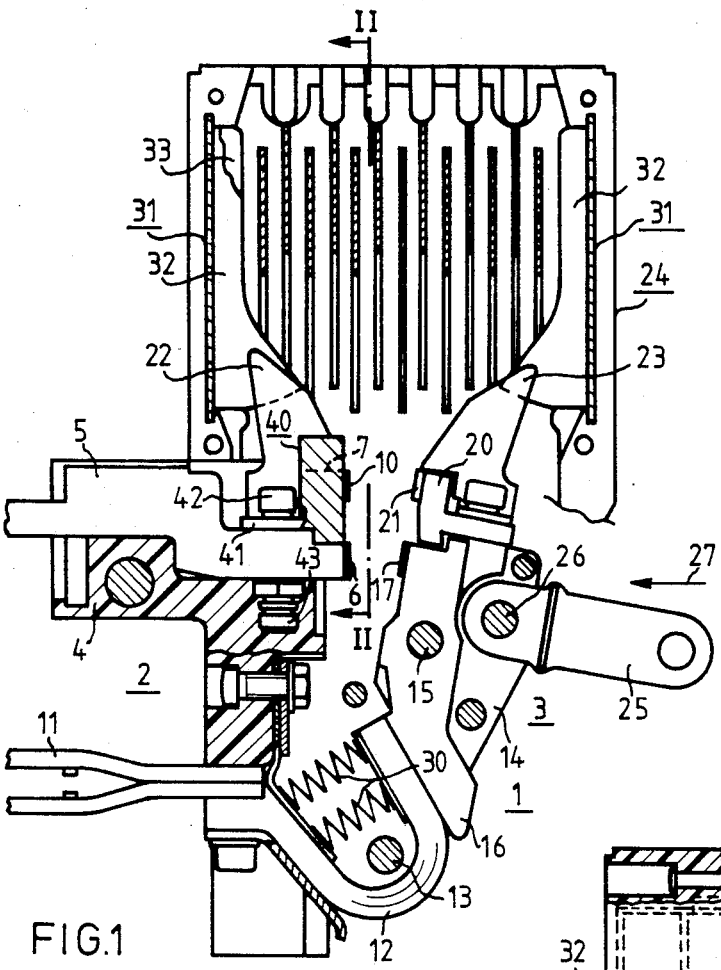
FIG. 1 shows the contact arrangement of a pole of a low-voltage circuit breaker in a side view, partially in cross section.
Figure 2:
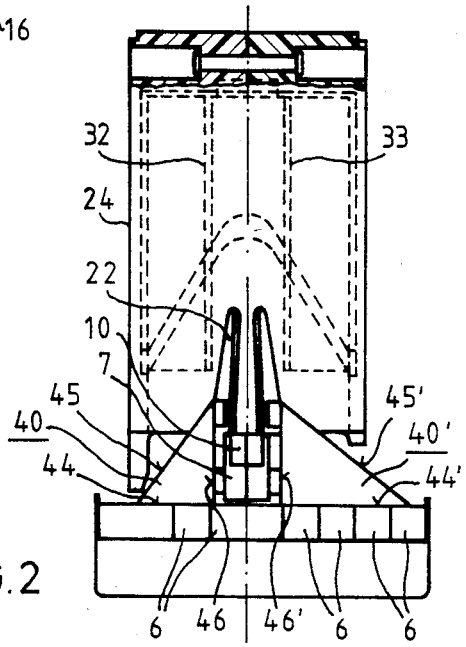
FIG. 2 shows a section II—II in FIG. 1, the left and the right part in FIG. 2 showing different embodiments.

The contact arrangement 1 according to FIGS. 1 and 2 comprises in a manner known per se a fixed part 2 and a movable part 3. As the carrier of the fixed part 2 of the contact arrangement 1 serves an insulating block 4, to which an upper contact bar 5 is attached which serves at the same time as the fixed main contact and is provided for this purpose with a contact overlay 6 or a larger number of such contact overlays. To the contact bar is fastened near the contact overlay 6, a fixed burn-off contact 7 which is likewise provided with a contact overlay 10. To the underside of the insulating block 4 with angular profile is fastened a further contact bar 11 of forked design, to which a flexible current-carrying ribbon 12 is connected by a screw connection. The current-carrying ribbon 12 establishes the electrically conducting connection with the movable part 3 of the contact arrangement 1 which is pivoted about a joint pin 13 arranged between the legs of the current-carrying ribbon 12 which is bent in U-shape. The movable part 3 comprises a carrier 14, at which main contact levers 16 are pivoted about a joint pin 15 and which are in connection with the current-carrying ribbon 12. They are equipped at their upper end with contact overlays 17 which cooperate with the stationary contact overlays 6. The carrier 14 further has a burn-off contact 20 which has a contact overlay cooperating with the stationary burn-off contact overlay 10. The stationary part 2 as well as the movable part 3 of the contact arrangement 1 have arcing horns 22 and 23 respectively, to transfer switching arcs into an arc quenching chamber 24.

As is shown in FIG. 2, two stationary contact overlays 6 are provided as the main contacts. Accordingly, the movable part 3 of the contact arrangement 5 comprises two contact levers, arranged side by side, with contact overlays 17. Depending on the current which the circuit breaker is to control with a permissible temperature rise, a greater number of main contacts can be provided. To illustrate this, two contact overlays 6 are shown in the right-hand part of FIG. 2, so that in this embodiment the contact arrangement has a total of four main contacts.

For switching on and off, the movable part of the contact arrangement 1 is connected flexibly via an actuating device of a suitable kind, not shown, to the carrier 14 by means of a pin 26 via an insulating coupling member 25. Starting with the off-position shown, the contact arrangement 1 is closed by moving the insulating coupling in the direction of the arrow 27, whereby first, the contact overlays 10 and 21 of the burn-off contacts and subsequently, the contact overlays 6 and 17 of the main contacts come into contact with each other. In the latch-locked end position of the actuating device, the bearing pin 26 acts as a stationary pivot of the carrier 14 so that then, compression springs 30 arranged between the legs of the current carrying ribbon bent in U-shape act as contact pressure springs. If, on the other hand, the actuating device is unlatched and thereby the insulating coupling 25 is released, the compression springs 30 act as switching-off springs and transfer the contact arrangement into the off position shown in FIG. 1.

If the motion of the parts is executed during the switching-off in a known manner in such a way that first, the main contacts and thereafter, the burn-off contacts are separated from each other, a switching arc is generated only at the burn-off contacts, unless the current flowing through the contact arrangement exceeds a certain magnitude. The switching arc is then taken over by the arcing horns 22 and 23 and is transferred into the arc quenching chamber 24. This process is aided in the known manner by guiding bars 31 which in the example shown have a U-shaped profile and are designed so that the tips of the arcing horns 22 and 23 lie between the legs 32 and 33 of the arc guiding bars 31. If, however, the flowing current exceeds a certain magnitude, the current is not commutated to the burn-off contacts completely with the result that partial arcs occur also at the main contacts, i.e., between the contact overlays 6 and 17. These are taken up by additional arc guiding pieces 40 and are likewise conducted to the arcing horns. The arc guiding pieces 40 are arranged symmetrically on both sides of the fixed burn-off contact 7 with the contact overlay 10 and have approximately triangular shape. For mounting, each arc guiding piece 40 is provided with an extension 41, which rests on the stationary contact part 5. A screw 42 serves for the common fastening of the contact bar 5 and the arc guiding piece 40 to the insulating block 2 by means of a threaded sleeve 43 embedded in the insulating block 2. An unimpeded take-over of the partial arcs from the main contact is achieved by proximity as close as possible between the lower edge 44 of the arc guiding piece 40 with the contact overlays 6. The further edges 45 and 46 serve as guiding edges of the partial arcs upward in the direction toward the arcing horns 22 and 23. To this end, these edges make an acute angle with each other and are designed so that they extend to the arcing horn 22 until above the contact overlay 10.

The different embodiments in the left-hand and the right-hand part of FIG. 2 show that the size of the arc guiding pieces can be adapted in a simple manner to the respectively provided number of main contacts. In accordance with the larger number of contact overlays 6 in the right-hand part of FIG. 2, the lower edge 44' of the arc guiding piece 40' is longer, as is the edge 44' leading to the arcing horn. The arc guiding pieces 40 and 40' can be made of sheet steel and with an angled-off portion serving for fastening. In the embodiment shown, the arc guiding pieces are made of cast steel, however, since in this manner the parts of different thickness desired for guiding the arcs and for fastening can be produced more easily. A relatively large thickness of the arc guiding pieces, i.e., an accordingly large mass of ferromagnetic material can be advantageous for the desired effect. Good results were obtained, for instance, in a circuit breaker for a rated current of 1600 A with two main contacts (left part of FIG. 2) in connection with two arc guiding pieces of case steel with a weight of 60 g each.

As is shown particularly in FIG. 1, only the fixed part 2 of the contact arrangement 1 is provided with arc guiding pieces. This arrangement has been found to be effective and has the advantage that the mass of the movable part 3 need not be increased by additional parts. However, also the movable part 3 could be equipped with arc guiding pieces and it may suffice to use arc guiding pieces of thinner material, for instance, of sheet steel in contrast to the described solid arc guiding pieces. In this case the increase of the moving mass is so small that an influence on the mechanical switching process cannot be ascertained.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A contact arrangement for a low-voltage circuit breaker having main contacts for conducting a continuous current and burn-off contacts for igniting a switching arc in the entrance area of an arc quenching chamber, and further having arcing horns for transferring the switching arc into the arc quenching chamber, at least two main contacts being arranged in a row next to each other and at least one burn-off contact being arranged spaced therefrom, an arc guiding piece of ferromagnetic material being arranged in a space between the main contacts and the burn-off contact, the arc guiding piece having an approximately triangular shape, one edge of the triangular shape disposed adjacent the main contacts, and a further edge disposed adjacent the space between a top edge of the main contacts and a top edge of the associated burn-off contact, said further edge extending past said top edge of the burn-off contact, two edges of the triangular shape of the arc guiding piece forming an acute angle leading to the arcing horn of the associated burn-off contact.

2. The contact arrangement recited in claim 1, wherein the arc guiding piece forms a steel casting and has a thick-walled part for guiding arcs and a thin-walled leg for fastening to the associated main contact.

3. The contact arrangement recited in claim 1, wherein only the stationary part of the contact arrangement is provided with said arc guiding pieces.

* * * * *